United States Patent [19]

Desnoes et al.

[11] 4,362,558

[45] Dec. 7, 1982

[54] PROCESS OF UPGRADING NICKELIFEROUS OXIDE ORES OF LATERITIC ORIGIN

[75] Inventors: André Desnoes, Plaisir; Jean-Jacques Predali, Elancourt; Guy Ranchin, Versailles, all of France

[73] Assignee: Societe Metallurgique le Nickel-SLN, Paris, France

[21] Appl. No.: 189,134

[22] Filed: Sep. 22, 1980

Related U.S. Application Data

[63] Continuation of Ser. No. 933,565, Aug. 14, 1978, abandoned, which is a continuation-in-part of Ser. No. 713,434, Aug. 11, 1976, abandoned.

[30] Foreign Application Priority Data

Aug. 14, 1975 [FR] France ..... 75 25428

[51] Int. Cl.[3] ..... C22B 1/00; C22C 38/08; B02C 19/00; B07B 1/00

[52] U.S. Cl. ..... 75/40; 75/82; 241/14; 241/15; 241/20; 241/21; 241/24

[58] Field of Search ..... 75/1 R, 1 T, 2, 21, 75/119, 40–44 R, 44 S, 82, 192; 299/17; 209/166, 172.5; 241/14–16, 20, 21, 24

[56] References Cited

U.S. PATENT DOCUMENTS

| | | | |
|---|---|---|---|
| 3,582,005 | 6/1971 | Archibald et al. | 75/1 R |
| 3,711,032 | 1/1973 | Weston | 241/20 |
| 3,775,090 | 11/1973 | O'Kane et al. | 75/1 R |
| 3,860,689 | 1/1975 | Sefton et al. | 75/119 |
| 4,175,790 | 11/1979 | Predali | 299/7 |

FOREIGN PATENT DOCUMENTS

| | | | |
|---|---|---|---|
| 2129856 | 3/1972 | France | 75/2 |
| 2320781 | 3/1977 | France . | |
| 42-24643 | 11/1967 | Japan . | |
| 52-23504 | 2/1977 | Japan . | |
| 1080210 | 8/1967 | United Kingdom . | |
| 1089933 | 11/1967 | United Kingdom . | |
| 1232183 | 5/1971 | United Kingdom . | |

OTHER PUBLICATIONS

Chemical Abstracts, vol. 80, No. 39503t, p. 155, A.C.S. (1974).

Boldt, J. R.; *The Winning of Nickel* D. V. Nostrand, Inc., New Jersey, p. 388 (1967)

Queneau, P. E., "The Recovery of Nickel from Its Ores", *Journal of Metals* pp. 44–45 (1970).

Ammou-Chokroum, "Mineralurgie du Nickel-Prospective Industrie Minerale", (2/76) pp. 57–63.

Translation of French Patent No. 2,320781 by Brian Clive Diamond, London, U.K., pp. 1–21.

Evans, D. J. I. et al.; International Latevite Symposium Soc. of Min. Eng. of AIMMPE, pp. 517–519 (1979).

*Primary Examiner*—Michael L. Lewis

*Attorney, Agent, or Firm*—Fleit & Jacobson

[57] ABSTRACT

A process of upgrading garnieritic ores, oxidized nickelifer ores of lateritic origin which includes subjecting the ore to controlled attrition and classifying particles so formed according to their size, those having a dimension smaller than a predetermined value being recovered.

38 Claims, No Drawings

PROCESS OF UPGRADING NICKELIFEROUS OXIDE ORES OF LATERITIC ORIGIN

This is a continuation of application Ser. No. 933,565, filed Aug. 14, 1978, now abandoned, which in turn is a continuation-in-part of Ser. No. 713,434, filed Aug. 11, 1976, now abandoned.

The present invention relates to a process of upgrading garnieritic ores, nickel oxide ores of lateritic origin, which are silicated rich ores.

The subject ores suitably have their major components within the general following limits:

Iron: 8 to 43% by weight;

Silica: 8 to 46% by weight;

Magnesia: 2 to 30% by weight;

Nickel: 1.20 to 3.20% by weight.

A typical example of such a nickel ore, found in the Pacific Island of New Caledonia, is garnierite. These garnieritic ores should be distinguished from true laterites (limonitic ores) which consist essentially of oxides and hydroxides of iron. Ores containing up to 70% silica may also be upgraded by the process of the present invention, a possible variation residing only in the duration of treatment.

Garnierite is usually processed in an electric furnace by a pyrometallurgical fusion process so as to form ferro-nickel. In this process, the ore is dried and mixed with a reducing agent to form a charge which is smelted within an electric furnace in which nickel is recovered in the form of ferro-nickel and in which the other elements are eliminated as slag. Thus, the major production of the heat supplied by the electric furnace is employed only to melt ingredients which are of little commercial importance, such as magnesia or silica. Thus, the profitability of ferro-nickel production units depends on the proportion of nickel in the charge for the furnace: the higher the nickel content, the greater the production capacity and the lower the power consumption per unit of nickel produced.

It has, however, become increasingly difficult to obtain charges possessing a sufficiently high proportion of nickel because of the progressive exhaustion of the richer ores. In the case of the company Societe le Nickel, the mean nickel content of ores worked has fallen from 4.1% in 1944 to 2.65% at present, the latter proportion obtained only by the application of various selective operations performed at the mining site.

(These selective operations consist of determining the zones to be worked by specifying a particular cut-off grade, which simultaneously determines the tonnage and the average nickel content. In the case of worked areas, unprofitable blocks are eliminated, either directly by the shovel operator or by the use of revolving screens set up close to the quarries. Therefore, average nickel content of ores supplied to the processing works is a compromise between proper management in the sphere of mining, which governs long-term supplies, and the need to ensure the profitability of the processing works.)

In an attempt to increase the nickel content of the ores obtained from the mines, research has been conducted for several years with respect to the upgrading of garnieritic ores prior to fusion. This necessitated a greater understanding of ores and their mineralogy. Upgrading of garnierites is a difficult problem, due to the variety of the facies and the location of the nickel, which is distributed in the main mineral phases of these ores which are iron hydroxides and hydrosilicates such as serpentines and clays. Despite this unfavourable distribution, it has previously been possible to raise the nickel content by 0.25 to 0.30% by only processing the fractions exceeding 10 mm. in size.

This technique which results in some improvement in nickel content does not, however, offer any decisive advance, since it yields results which vary with the composition of the ore and has proved to be inadequate to resolve the problems of certain deposits, such as those of Tiebaghi and Poum (in the north of New Caledonia). In these areas it is difficult to obtain a sufficiently high nickel content using conventional techniques.

An object of the present invention is to provide process for upgrading a garnieritic ore to significantly increase the nickel content of the material to be charged to the furnace.

Another object of the present invention is to provide a process which renders it possible to upgrade lowgrade ores and thus to increase the workable reserves of nickeliferous deposits of the garnieritic type.

The process of the present invention for upgrading garnieritic ores basically comprises the following steps:

(a) subjecting the ore to a controlled attrition, (b) recovering the particles of the ore below a predetermined size.

At this stage, it is best to define the term "controlled attrition" (hereinafter sometimes simply referred to as "attrition").

In order to clearly understand this completely novel process, one must return to some basic principles.

Most ores, especially oxide ores, consist of pebbles (or coarse particles) mixed with slimes or mud composed of fine particles held together by very weak forces, such as surface tension. Usually, at first, the slimes are separated from the pebbles by a washing operation. The valuable part of the ore sometimes resides in the slimes, sometimes in the pebbles and sometimes in both. In the case of garnieritic nickeliferous ores, however, this washing is not necessary, since there is very little slime present (from none to 15–20% and exceptionally to 50%). In addition, for these special ores, it has been found that one valuable part of the pebbles or coarse particles is more brittle than the less valuable part, even though both parts have about the same mineralogical structure. Controlled attrition surprisingly results in the creation of fine particles without breaking the coarse particles and in an upgrading of the ore.

It is certainly very surprising and surely quite rare to encounter an ore having a very friable part which has the same structure as the remainder. Because of this structure, it has been suprisingly found that mild collision can effect a removal of the friable part without breaking the mother particles. This is the basis of a controlled attrition.

Before discussing exactly what constitutes a controlled attrition, it is best to consider what a controlled attrition is not. Controlled attrition, despite the literal conventional definition of attrition, is not a grinding or scuffing or pulverization. It is not a rough fragmentation or is it a breaking or crumbling. When discussed in terms of a wet attrition, the attrition is not merely washing or flotation.

In essence, a controlled attrition accomplishes a particle redistribution via the elimination of the cohesive forces that hold the friable parts to the ore particles.

These cohesive forces are eliminated by a moderate mechanical action or shaking which frees the friable parts from the ore particles without breaking them.

When plotted on a Rosin-Rammler diagram, a series of straight lines corresponding to the size ranges obtained by successive controlled attritions tend to the horizontal, in contrast to those corresponding to the size ranges obtained by successive crushings which remain parallel to each other or which have a tendency to become vertical. The Rosin-Rammler diagram, however, does not teach the precise conditions for a controlled attrition, but does provide an excellent test for one skilled in the art to determine whether the proper conditions for a controlled attrition have, in fact, been chosen. In this regard, one could also employ the empirical equations of Rittinger, Coghill and Bond to find the worst possible conditions for grinding to determine the best conditions for a controlled attrition.

Although examination of a Rosin-Rammler diagram provides the most exact criterion and is best suited for differentiating controlled attrition from grinding or pulverization, there are secondary criteria which may also be considered. One may define a controlled attrition on the basis that the $d_{100}$ does not decrease more than 50% (preferably not more than 25%) is the course of a controlled attrition, however long it may be carried out. The $d_{100}$ is defined as the smallest mesh through which 100% of product is able to pass. This criteria is usable but not very satisfactory since the $d_{100}$ corresponds to the dimension of the largest particle.

It is also possible to define controlled attrition by the fact that, the $d_{90}$ and the $d_{80}$ do not decrease more than 75 and 100%, respectively, and preferably not more than 20 and 30%, respectively.

Another satisfactory secondary criterion defines a controlled attrition by the fact that the $d_{80}/d_{20}$ relationship increases in the course of successive attritions by at least a factor of 1.5. Finally, the ratio $d_{90}/d_{10}$ is multiplied by a factor of at least 2 and preferably greater than 10 as a result of the attrition operation. On the other hand, it should be noted, as is shown in the Examples comparing grinding and controlled attrition, that the ratio $d_{90}/d_{10}$ decreases slightly as a result of grinding. There is also a relationship between the ratio $d_{90}/d_{10}$ or the ratio $d_{80}/d_{20}$ and the slope of the straight line on the Rosin-Rammler diagram.

Next, an overview of a scheme employing a controlled attrition to accomplish the upgrading of an ore is set forth.

At first, the ore is mined to produce a crude ore which may be washed to produce, on one hand, the slimes which have a high nickel content and, on the other hand, the pebbles which may be subjected to a preliminary crushing to produce coarse particles of a size between 100 and 2,000 microns. Next, the coarse particles are subjected to a controlled attrition, a shaking without breaking, which produces partly exhausted coarse particles and fine particles which are rich in nickel, even more so than the slimes. If only partly exhausted of nickel, these coarse particles may again be subjected to a controlled attrition to produce exhausted coarse particles, which may be considered as tailings, and fine particles, rich in nickel.

Generally for the subject garnieritic nickeliferous ore it may be noted that the ore must undergo a preliminary crushing so that 80% of the particles (mother particles) are of a size between 5000 and 100 microns and preferably between 1000 and 200 microns. There are, however, very little slimes (from none to 15–20%), and there is no real structural discontinuity between the nickel rich and nickel poor parts of the coarse particles.

Thus, controlled attrition when coupled with a separation of coarse and fine particles results in an upgraded ore ready for further processing. It is important to note that carrying out a controlled attrition does not affect particle size but only effects a particle redistribution within the ore allowing recovery of the nickel rich fine particles.

Now follows a more detailed description of controlled attrition. The conditions for carrying out this novel process, examples demonstrating the differences between controlled attrition and grinding, and examples of actual upgrading of various ores are set forth below.

In the processing of ore, mills usually used in the mining industry are designed to fragment the ore particles by causing collisions between the particles or between the particles and crushing bodies. Abrasion caused by friction between the different parts in the crusher is only a superfluous secondary phenomenon, since the fines are always considered as a source of difficulty in further treatment. Typically, therefore, in rotating mills, the speed of rotation and the size of the crushing blocks are selected to obtain breakage of all particles. So, the speed of rotation for crushing or grinding is generally chosen between 60 and 80% of the critical speed. The critical speed is the speed at which the charge begins to be centrifuged and no longer displays a cataract effect.

Since it is a primary object of controlled attrition to avoid any grinding, crushing or the like, the proper speed of rotation for carrying out a controlled attrition must reside outside of the above mentioned range for grinding, so that the particles do not exhibit waterfall or cataract effect. It has been found that when there is no waterfall or cataract effect, there is little or no grinding effect. So, the range of speeds for carrying out a controlled attrition can be chosen to encompass either less than 60% or between 80 and 100% of the critical speed. At the critical speed the particles are centrifuged, so they do not affect each other significantly either for grinding or for a controlled attrition. Therefore, the critical speed should also be avoided in conducting a controlled attrition. For a controlled attrition, the composition of the speed vectors of two mother particles should be less than about 5 m/sec and preferably between 2 and 4 m/sec. In other words, when two mother particles collide, their relative speed should be less than about 5 m/sec and preferably between 0 and 4 m/sec. When the attrition is performed on a pulp, the agitated volume must pass through the agitating moving device, e.g., a propeller, between about 1,000 and 10,000 times per hour, preferably between 3,000 and 5,000 times per hour.

The speed vectors of the two mother particles can generally be quite easily calculated or measured, and when the attrition is performed on a pulp, the speed vector is between about 2 and 15 times the speed of the pulp when it passes through the agitating moving device, impellor or propellor. The pulp speed is easily calculated from the manufacturer's data for the particular device employed. For the speed vectors to be in the preferred range, the speed of the pulp should be between about 0.9 and 2.4 m/sec.

The solid ratio of the pulp is advantageously between 60 and 80%, the preferred range being 65–75%.

It is also known that one may determine the optimal dimensions of the crushing body by using empirical relationships, for example those of Rittinger, Coghill or Bond. The optimization of crushing is the subject of numerous publications which are reviewed by P. Blazy in "La Valorisation des Minerais", University Press of France, Paris 1970, especially at pages 42 to 44. As discussed above, one skilled in the art can determine the conditions resulting in a good fragmentation and thus conversly, the conditions for a good controlled attrition. In this regard, it is noted that crushing bodies which are particles of mineral of a dimension between 1 and 5 mm can be used advantageously.

Controlled attrition may be performed on the dry material as discussed, or in a pulp. Pulping may be effected in the mine by hydraulic mining. The attrition may be performed by, for example, simply stirring a pulp within a revolving vat or a washing drum. In some cases, the stirring coupled with the pulp action is adequate to perform an appropriate attrition. Any other know method of inducing a moderate mechanical action may also be used.

Classification and recovery may be performed in accordance with conventional methods of the art, e.g., by screening. Coarser separation can be carried out with sieves (riddles) and finer separation with hydroseparators or sorters. The finest particles can be separated by means of hydrocyclones, after decanting and filtering.

The dimension below which particles are recovered is 50 microns, preferably 10 microns, this later value being critical if high upgrading (more than 1%) is wished.

Many factors affect the upgrading of an ore's nickel content including the origin of the ore, the manner of performing the controlled attrition, the particle size distribution (granulometry) obtained after controlled attrition, the cut-off point and the number of times the treatment is repeated. In general, a smaller particle size yields a higher nickel content in the recovered fraction, but at a lower rate of recovery. The following table, obtained from the data of Example 1, demonstrates this relationship for a Tiebaghi ore.

| | Particle Size | Nickel Content % by Wt. | Nickel Recovery % by Wt. |
|---|---|---|---|
| Feed | 0–80 mm | 2.47 | 100 |
| Fraction | <10 microns | 3.64 | 38 |
| Fraction | <40 microns | 3.36 | 46 |
| Fraction | <125 microns | 3.00 | 63 |

The proportion of the ore from which nickel is recovered may be increased either by continuing the controlled attrition to increase the proportion of fine particles, or by reprocessing the screened-out particles, with, if appropriate, a crushing action prior to pulping. Surprisingly, it was observed that the nickel content of the fine particles obtained after such second processing (which may be referred to as "secondary fines") is at least often equal to those of the fine particles derived from the first processing operation (referred to as "primary fine").

One of the most satisfactory methods found for carrying out the present invention involves the separation of the fines and the repetition of the process of the invention as many times as required to obtain an acceptable recovery rate, yet maintaining a considerable upgrading of the ore. For example, the attrition may be performed in one to five, preferably one to three, operations the duration of each being between 20 minutes to 2 hours with the duration of each operation increasing with each successive attrition. In any event, the total duration of the attrition should be from about 1 to 5 hours, preferably between 1 to 3 hours.

The nickel-enriched fractions, if they comprise fine particles in the form of pulp containing 10 to 40 g/l of solid, should have a water content compatible with processing at the plant, that is containing not more than 25 to 35% water, since such fractions do not filter satisfactorily and decantation takes place too slowly for industrial operations. It has also been found that by controlling the conditions of pH, and the proportions of inorganic electrolyte and of organic flocculants, one can control the formation of large flocs to ensure an adequate decanting speed and a sufficiently thickened pulp allowing it to be filtered by conventional techniques to form a cake of appropriate water content.

Preferred flocculants are organic flocculants having polar groups such as amide, ether or ester, specific examples being polyacrylamides sold under the Trade Mark "Separan", the polyethylene glycols sold under the brand name "Floerger FA10" and the copolymers of acrylamide and acrylate sold under the Trade Mark "Sedipur T.F.5". The decanting action is more satisfactory when a higher molecular weight flocculant is employed. Preferably the amount of flocculant used is between 100 and 2000 g per tonne of dry material processed, and preferably between 100 and 500.

The addition of inorganic electrolytes, such as magnesium sulphate, is useful for promotion of flocculation by causing a preliminary coagulation of the particles.

The solids content of the suspension to be flocculated is preferably between 10 and 80 g per liter, more preferably 15 to 30 g.

The preferred pH range depends on the ionicity of the flocculant used. Thus, with an anionic flocculant, it is between 5 and 9, while with a non-ionic flocculant it is below 7.

Although the ore fraction smaller than 10 microns already has a high nickel content and a very fine particle size, it is still possible to further increase its nickel content by a further diminution of the cut-off size. This requires even more elaborate classification and recovery techniques, but a nickel content of near 6% is possible. It is also possible to benefit from the fineness of the particles to upgrade the ore in the liquid phase by a high intensity magnetic separation.

The lower limit for which a conventional hydrocyclone may be employed is about 7 microns, although a greater upgrading can be obtained using separation centrifugation apparatus. It appears, however, that no further upgrading is possible after lowering the cut-off size to less than about 0.1 micron.

If the tailings of oversize particles are discarded, the nickel they contain is lost. This loss may be substantial if considerable upgradings are required and may consequently be incompatible with proper management of the mining field.

This nickel can be recovered by a physical upgrading, such as by separation within a heavy medium for particles of dimensions exceeding 0.50 mm and by high-intensity magnetic separation which is particularly appropriate for particles having a size of between 0.05 mm and 1 mm, or by a chemical method by hydrometallurgical processes. These physical upgrading techniques are well known to those skilled in the art and are particularly described in "La Valorisation des Minerais" by P. Blazy, French University Press, Paris 1970. It is also possible to alternate between the physical treatments mentioned above and the process of upgrading by attrition.

The productive capacity and the energy field of pyrometallurgical plants are directly proportional to the nickel content of the charge; it is therefore evident that the upgrading process of the present invention will produce a substantial increase in the capacity of production of reduced nickeliferous compounds, such as mattes and ferro-nickels, and an increase in the usable reserves, e.g., by 50% or much more in the case of the Tiebaghi deposit.

Another major advantage of the process of the present invention resides in its ease of adaptation to the economic conditions of the place and time at which it is employed. In the practice of the present invention, it is possible to fix values for different parameters such as the range of particle size and the cut-off grade to secure the best compromise between the nickel content and the rate of recovery and thus produce the most efficient method of operation.

It should be emphasized that the concentrate obtained by the process of the invention presents a ratio $MgO/SiO_2$ favorable for further smelting into ferro-nickel ($MgO/SiO_2$ comprised between 0.45 and 70).

These remarkable results are difficult to explain. Following intensive mineralogical research performed by electronic microprobe, it appears that the nickel is preferentially bonded with fine inorganic particles of argillaceous size (clay or hydroxide), or even colloidal size (gel) in which it is commonly combined with iron. These particles may form relatively independent aggregates at the locus of primary siliceous ores which are destroyed by the lateritic alteration, or may be scattered in a more or less heterogenous manner in other silicates in which the morphology is retained, but which are nevertheless greatly altered. The abundance of the nickeliferous particles would commonly be greater, on any scale of observation, in the most porous and most brittle parts.

The process of the present invention takes advantage of these heterogeneities in the natural structure of the ore. The washing operations selectively disintegrate the most friable parts and release rich nickeliferous particles without crumbling the more compact parts which are relatively denuded of nickel. This would explain why one obtains a granulometric distribution in which the fine fractions mainly constitute nickeliferous particles and therefore have a higher nickel compared to the feed material.

Now follows a series of examples to first show that a preliminary crushing or grinding produces relatively few fine particles compared with controlled attritions and second to show the difference between controlled attrition and grinding.

EXAMPLES SHOWING THAT A PRELIMINARY GRINDING PRODUCES FEW FINE PARTICLES COMPARED WITH LATER ATTRITIONS

The attrition operations are possible only after a preliminary washing of the elutriated ore having a granulometry between 100 and 5000 microns and preferably between 200 and 1000 microns. This preliminary washing produces a very small amount of fine particles (less than 10 microns) in comparison with subsequent attrition operations.

For example, a Bonini ore characterized by a Ni content of 1.50% is treated according to the following operations:

washing of the unsorted material and recovery of the fine particles;

reduction of the unsorted material, elutriated, with a $d_{80}$ of 40 mm to a $d_{80}$ of 1 mm by crushing then grinding;

treatment by attrition of the unsorted material, which has been washed and reduced to 1 mm.

Four attrition operations are then carried out, with respective durations of 10, 50, 60, and 120 minutes, with each followed by a centrifuging of 10 microns which permits the recovery of the fine particles rich in Ni.

The solids concentration is 70%.

| Product | % Weight | % Ni | Recovery Ni % |
|---|---|---|---|
| Fine particles from washing (1) | 10,70 | 3,36 | 23,80 |
| Fine particles from preliminary grinding (2) | 2,00 | 2,78 | 3,68 |
| Fine particles from attrition (3) | 24,04 | 2,93 | 46,72 |
| Concentrate (1) + (2) + (3) | 36,74 | 3,06 | 74,20 |
| Feeding | 100,00 | 1,51 | 100,00 |

This example, therefore, clearly demonstrates that the fine particles which are produced from the preliminary grinding represent only a small weight percentage in relation to the fine particles produced by attrition.

The example also shows that an ore with a very low initial content, 1.51% of Ni, is very favorably enriched as a result of the present inventive process, since a concentrate of 3.06% Ni with a metal recovery of 74.2% is obtained.

EXAMPLES SHOWING THE DIFFERENCES BETWEEN ATTRITION AND GRINDING

A Si Reis ore such as that described above, titrating: 2.30% Ni, 10.3% Fe, 28.4% MgO, and 46.5% $SiO_2$ is treated for comparative purposes by grinding and attrition.

It is first washed to 10 microns, then it undergoes a preliminary grinding which brings its $d_{80}$ to 1500 microns.

Conditions of Grinding

Grinding in a grinder with balls turning at 78% of its critical speed and containing 0.5 kg of ore, 0.5 kg of water and 28 balls of 40 mm diameter.

Three runs were carried out, with the duration of grinding equal to, respectively, 20, 40, and 60 minutes.

Conditions of Attrition

The conditions are those defined above for the Si Reis ore.

Comparison of Results

The table and the figures which follow supply different means of making a comparison according to the slope of the granulometric curves.

Comparison of Grinding and Attrition (Percentage of weight of granulometric classes)

| Class | Granulometry | Unsorted Material wt % | GRINDING wt % 20 mn | 40 mn | 60 mn | ATTRITION wt % 20 mn | 40 mn | 60 mn |
|---|---|---|---|---|---|---|---|---|
| 1 | 1–2 | 0 | 2,6 | 4,0 | 5,0 | 1,2 | 2,3 | 2,5 |
| 2 | 2–4 | 0 | 4,4 | 7,0 | 10,3 | 1,9 | 2,5 | 3,0 |
| 3 | 4–8 | 0 | 7,8 | 12,0 | 13,5 | 1,6 | 4,0 | 4,0 |
| 4 | 8–16 | 0 | 12,0 | 17,5 | 21,5 | 3,8 | 5,0 | 6,0 |
| 5 | 16–32 | 3,8 | 18,0 | 22,5 | 23,0 | 5,0 | 6,0 | 6,0 |
| 6 | 32–64 | 9,2 | 22,0 | 20,0 | 14,5 | 8,5 | 7,0 | 8,0 |
| 7 | 64–128 | 12,5 | 19,5 | 11,5 | 4,6 | 10,0 | 10,0 | 9,0 |
| 8 | 128–256 | 14,5 | 8,8 | 2,0 | 0,4 | 11,5 | 10,0 | 10,0 |
| 9 | 256–512 | 15,5 | | | | 12,5 | 13,0 | 11,5 |
| 10 | 512–1024 | 17,0 | | | | 17,5 | 12,0 | 10,5 |
| 11 | 1024–2048 | 14,5 | | | | 14,5 | 11,0 | 9 |
| 12 | 2048–4096 | 8,0 | | | | 8,0 | 7,0 | 6 |

It should be noted that following the initial grinding, no particles are found of a size greater than 256μ, which is consistent with the grinding operation. It is especially significant to note that even after being subjected to two hours of a controlled attrition the granulometry of the ore is still comparable to that of the unsorted material, with the notable exception of the "creation" of particles of less than 16μ, the nickel rich fines.

According to the above results, it is clear that successive grindings produce linear granulometric curves which pivot around a point, with the exception of experimental errors.

More precisely, these straight lines can be characterized by two points: the $d_{80}$ (dimension for which the passing material represents 80% of the weight) and the $d_{20}$ (dimension for which the passing material represents 20% of the weight), which develop in a very different way according to the process, as shown in the following table.

| Characteristic Point | Unsorted Material | GRINDING(mn) 20 | 40 | 60 | ATTRITION(mn) 20 | 40 | 60 |
|---|---|---|---|---|---|---|---|
| $d_{90}$ in μm | 2400 | 130 | 70 | 48 | 2400 | 2400 | 2400 |
| $d_{80}$ in μm | 1500 | 80 | 50 | 37 | 1400 | 1350 | 1200 |
| $d_{20}$ in μm | 90 | 10 | 5,4 | 3,8 | 60 | 24 | 11 |
| $d_{10}$ in μm | 52 | 3,7 | 2,3 | 1,6 | 24 | 6 | 2,5 |
| $d_{90}/d_{10}$ | 46 | 35 | 30 | 30 | 100 | 600 | 960 |
| $d_{80}/d_{20}$ | 16,5 | 8 | 9 | 9 | 24 | 60 | 110 |

The above table clearly displays the distinction between grinding and the controlled attrition of the present invention. As shown therein, the secondary criteria, i.e., $d_{90}/d_{10}$ and $d_{80}/d_{20}$, decrease slightly from the unsorted material even upon successive grindings but exhibit a strong and dramatic increase upon the initial and successive controlled attritions.

EXAMPLES DEMONSTRATING THE METALLURGIC RESULTS OF ENRICHMENT BY CONTROLLED ATTRITION

Several examples concerning ores with different geographic locations and different mineral types are provided below which show a minimum recovery rate of 70% and a minimum enrichment in nickel of at least 1%.

Si Reis Ore

An ore of the Si Reis bed titrating 2.30% of Ni, and which comprises various phases such as peridotite not serpentizied and very serpentinized, the harder pebbles corresponding to a green harzburgite more or less altered, is treated according to the following outline:

reduction to 20 mm in a jaw-type crusher;

grinding to 2.5 mm of the preceding fraction+2.5 mm;

washing of the entirety by centrifuging at 10;

the fraction less than 10 microns constitutes a first concentrate;

the fraction greater than 10 microns is worn down in the course of three successive operations separated by a centrifuging at 10 to recover the fine products in each treatment.

The feed of the attrition has an initial granulometry characterized by a $d_{80}$ of 1000 microns.

Each attrition lasts 20 minutes. The solids concentration during all operations is on the order of 65%. The attrition concentrate is essential formed by serpentines and limonites.

The metallurgical summary of the operation is as follows:

| | Weight % | DENSITY Ni | Fe | MgO | $SiO_2$ | Recovery of Ni | MgO/$SiO_2$ |
|---|---|---|---|---|---|---|---|
| Concentrate (fraction − 10) | 52,3 | 3,36 | 12,0 | 23,1 | 43,9 | 76,7 | 0.53 |
| Reject (fraction + 10) | 47,7 | 1,12 | 8,4 | 34,3 | 49,4 | 23,3 | 0,69 |
| Feeding | 100,0 | 2,29 | 10,3 | 28,4 | 46,5 | 100,0 | 0,61 |

This example clearly demonstrates a significant upgrading coupled with a good nickel recovery. Although the $MgO/SiO_2$ ratio decreases, it is still satisfactory for smelting into ferro-nickel.

The following three examples demonstrate the effects of a controlled attrition performed in pulp on Si Reis ore having essentially the same composition as used in the previous example.

EXAMPLE A

Pulp volume: 500 l.

Pulp speed when it passes through the agitating moving device 1.6 m/s.

Diameter of the impellor: 0.55 m.

The agitated volume passes through the agitating moving device (impellor) 5,400 times per hour.

The pulp contains 70% of solid materials.

| attrition duration (mn) | d80 of the feed in microns | d80 of the concentrate in microns | Yield in weight % | Nickel content (%) Concentrate | Tailing | Feed | Nickel recovery yield % |
|---|---|---|---|---|---|---|---|
| 0 | | 14 | 30 | 3.34 | 1.76 | 2.23 | 45 |
| 20 | 300 | 16 | 43 | 3.28 | 1.44 | 2.23 | 63 |
| 60 | 300 | 16 | 51 | 3.22 | 1.18 | 2.23 | 74 |
| 120 | 300 | 16 | 59 | 3.11 | 0.94 | 2.23 | 83 |
| 240 | 300 | 16 | 65 | 3.00 | 0.82 | 2.23 | 87 |

EXAMPLE B

The ore used is the same as in the previous example.

d80 of the feed: 300 microns.

Pulp speed: 0.9 m/s.

Pulp volume: 5,000 l.

The pulp passes through the agitating moving device between 3,000 and 4,000 times per hour.

| attrition duration (mn) | Yield in Weight % | d80 of the concentrate in microns | Nickel content (%) Concentrate | Tailing | Feed | Nickel recovery yield % |
|---|---|---|---|---|---|---|
| 0 | 28 | 10 | 3.58 | 1.88 | 2.36 | 42 |
| 45 | 42 | 18 | 3.52 | 1.61 | 2.36 | 63 |
| 135 | 49 | 12 | 3.49 | 1.51 | 2.36 | 72 |
| 270 | 55 | 12 | 3.43 | 1.34 | 2.36 | 80 |

EXAMPLE C

Various tests were performed in the same conditions as in the previous example but the d80 of the concentrate varies as well as the d80 of the feed. The solid ratio in the pulp varies too.

| d80 of the concentrate | Pulp solid ratio (%) | d80 of the feed | Attrition duration | Pulp speed m/s | Yield in weight | % Ni |
|---|---|---|---|---|---|---|
| 7 | 64 | 550 | 30 | 1.35 | 4.7 | 4.0 |
| 7 | 73 | 650 | 30 | 1.35 | 12.7 | 4.2 |
| 7 | 63.8 | 550 | 60 | 1.35 | 7.4 | 4.2 |
| 7 | 58.3 | 550 | 30 | 1.35 | 4.8 | 4.4 |
| 7 | 61.3 | 900 | 60 | 1.35 | 5.8 | 4.5 |
| 7 | 61.3 | 300 | 60 | 1.07 | 3.9 | 4.2 |
| 10 | 65.5 | 200 | 60 | 1.07 | 9.2 | 3.4 |
| 10 | 56.2 | 300 | 60 | 1.07 | 7.7 | 3.4 |
| 10 | 59.7 | 500 | 60 | 1.35 | 5.5 | 3.9 |
| 7 | 61.3 | 400 | 60 | 1.50 | 5.0 | 4.2 |
| 10 | 56 | 200 | 60 | 1.50 | 13.5 | 3.4 |
| 10 | 63.5 | 300 | 60 | 2.23 | 5.8 | 3.2 |
| 10 | 59.7 | 500 | 60 | 1.35 | 6.4 | 3.6 |

Tiebaghi Ore—M Face

A Tiebaghi ore having the following characteristics: % Ni: 2.48; % Fe: 17.43; % $SiO_2$: 39.27; % MgO: 14.85, is treated according to the process of the invention:

reduction to 20 mm in a jaw-type crusher;

grinding to 2.5 mm of the fraction greater than 2.5 mm;

washing of the entirely to recover the fraction less than 10 microns which constitutes a concentrate;

treatment of the fraction greater than 10 microns by three attritions with respective durations of one hour, with each one followed by a centrifuging of 10 microns to recover fine portions.

The solids concentration is maintained at 70%.

| PRODUCT | Metallurgical Summary Obtained according to the Invention: Weight % | % Ni | Recovery of Ni | Ratio: $MgO/SiO_2$ |
|---|---|---|---|---|
| Primary fine particles | 31,13 | 3,83 | 48,08 | |
| Primary fine particles and fine particles, 1st and 2nd attrition | 41.74 | 3,78 | 63,61 | |
| Primary fine particles and find particles, 1st, 2nd, and 3rd attrition | 48,24 | 3,68 | 71,67 | |
| Unsorted material | 53,77 | 3,58 | 77,56 | 0,45 |
| | 100,00 | 2,48 | 100,00 | 0,38 |

In this operation, if one considers the entirely of the particles less than 40 microns obtained after three hours of attrition, one obtains a concentrate which has the following characteristics:

% weight: 17.67; % Ni: 3.10; recovery of Ni: 89.5.

It should be noted that for the Tiebaghi ore, the ratio of the primary fines is abnormally high and that the $MgO/SiO_2$ becomes convenient for smelting in the concentrate. The nickel recovery ratio is excellent.

Poro Ore

A Poro ore having the following characteristics: % Ni: 2.45; % Fe: 10.6; % $SiO_2$: 43.4 and % MgO: 29.2, is treated according to the process of the invention:

reduction to 20 mm in a jaw-type crusher;

grinding to 2.5 mm of the fraction greater than 2.5 mm;

washing of the entirely to 10 microns with recovery of the fraction less than 10 microns and treatment of the fraction greater than 10 microns which has a $d_{80}$ of 1200 microns in attrition.

One carries our four attritions, each with a respective duration of 20, 25, 30 and 30 mn, with each one followed by a washing and recovery of the fraction less than 10 microns which constitutes the concentrate, while the fraction greater than 10 microns is retreated in the following attrition.

The solids concentration is maintained at 65%. The metallurical summary of the entire treatment is as follows:

| Product | % Weight | CONTENT % Ni | Fe | $SiO_2$ | MgO | Ni recovery in % | $MgO/SiO_2$ |
|---|---|---|---|---|---|---|---|
| Fine particles | 11,7 | 3,93 | 21,9 | 33,9 | 17,9 | 18,8 | 0,53 |

-continued

| Product | % Weight | CONTENT % Ni | Fe | $SiO_2$ | MgO | Ni recovery in % | $MgO/SiO_2$ |
|---|---|---|---|---|---|---|---|
| from washing | | | | | | | |
| Fine particles from washing & attrition | 47,0 | 3,81 | 15,7 | 38,7 | 21,9 | 73,2 | 0,57 |
| Reject | 53,0 | 1,24 | 6,1 | 47,5 | 35,7 | 26,8 | 0,75 |
| Feeding | 100,00 | 2,45 | 10,6 | 43,4 | 29,2 | 100,0 | 0,67 |

The $MgO/SiO_2$ ratio decreases but is still suitable for smelting.

Acid Ore

A very acid ore with the following characteristics: % Ni:1.60; % MgO: 16.3%; % $Fe_2O_3$: 7.8 and % $SiO_2$: 67.0—which is treated according to the process of the invention:

reduction to 20 mm then to 2.5 mm;

washing and recovery by centrifuging to 10 microns of fine particles;

treatment of the fraction greater than 10 microns by a process of attrition in the course of three successive operations with a respective duration of 5, 15 and 30 minutes, with each one followed by a centrifuging to extract the particles below 10 microns—which constitute the concentrate—and the solids concentration remains equal to 60% in the course of the different operations of attrition.

The sample used in Examples 1 to 7, 9 and 12 came from a batch of 300 tons taken by a Benoto drill from the Tiebaghi deposit in the most important part (zone Gisele) of the concession of the company "Societe Metallurgique le Mickel—S.L.N.". This ore is representative of a deposit worked at a cut-off grade of 2% in both its chemical composition and structure.

EXAMPLE 1

One tonne (1000 kg) of the aforesaid sample, having a water content of 25.28% by weight and a particle size ranging from 0 to 80 mm, was mixed with water in the proportion of 150 kg of ore to 100 liters of water. The mixture was shaken in a revolving vat for 20 minutes, at the end of which time the mixture formed a thick pulp of homogenous appearance. This pulp was passed through a 2.5 mm screen, and the fraction smaller than 2.5 mm was then graded in a hydrocyclone which permitted separation of particles smaller than 10 microns.

Metallurgical Summary

| Product | % Weight | CONTENT % Ni | $SiO_2$ | MgO | $Fe_2O_3$ | Recovery of Ni in % | $MgO/SiO_2$ |
|---|---|---|---|---|---|---|---|
| Concentrate: fractions-10 after attrition and washing | 41 | 3,08 | 43,3 | 28,4 | 12,1 | 77,34 | 0,66 |
| Fraction 10–40 after treatment | 15,8 | 0,86 | | | | 8,44 | |
| Fractions + 40 after treatment | 43,2 | 0,53 | | | | 14,22 | — |
| Feeding | 100,0 | 1,61 | 67,00 | 16,3 | 7,8 | 100,00 | 0,24 |

In recovering the entirety of the fractions lower than 40 microns obtained after the three attritions, one thus obtains a concentrate titrating: 2.48% of Ni, and representing 85.78% of the metal for a weight return of 56.8%. The $MgO/SiO_2$ ratio of this concentrate is 0.66, thus extremely advantageous for a fusion process, in comparison with its value in the unsorted material. Thus it is seen that the treatment of acidic ores, i.e., ores containing more than 55% of silica, differs with respect to the duration of attrition. The lowest total duration of acidic ore attrition should be at least half an hour, whereas the duration of each attrition may be between about five minutes and one hour. For the acid ores, a very good upgrading and nickel recovery as well as a substantial increase in the $MgO/SiO_2$ ratio are obtained.

The following non-limiting examples also serve to illustrate the present invention and will enable those skilled in the art to determine operating conditions which are appropriate in each particular case. The results can easily be applied on an industrial scale. Percentages were by weight unless otherwise specified.

The two fractions were then further classified by passing them through sieves with 25 mm, 12.5 mm and 5 mm mesh sizes for the coarser fraction and with 1 mm, 0.5 mm, 0.250 mm, 0.125 mm, 0.063 mm, 0.040 mm and 0.020 mm mesh sizes for the fraction smaller than 2.5 mm. The particles were thus classified by size into 14 size ranges each of which was subjected to a complete chemical analysis.

The results are shown in the following Table 1. The left hand columns show the particle size limits (in mm) of each fraction and the percentage of the total particles in that fraction. The next nine columns show the analysis (including the metal content in (%) of that component in each fraction and the remaining nine columns show the percentage of the total weight of that component which is found in that fraction. The abbreviation I.L.=ignition loss which indicates organic matter.

Table 1 demonstrates that a high nickel content was obtained in the fine fractions most distinctly below 0.125 mm. This nickel enrichment is correlated with an iron enrichment and a lowered silica content. The highest nickel content (3.64%) was found in the finest fraction of size less than 0.10 mm.

BEST AVAILABLE COPY

TABLE 1

| | % | Ni | Co | Fe | Cr | $SiO_2$ | MgO | $Al_2O_3$ | I.L. | $CO_2$ |
|---|---|---|---|---|---|---|---|---|---|---|
| >50 mm | 5,31 | 1,52 | 0,09 | 10,2 | 0,41 | 60,00 | 12,3 | 1,9 | 8,5 | 2,30 |
| 50–25 | 5,57 | 2,16 | 0,11 | 12,5 | 0,48 | 46,00 | 17,1 | 3,6 | 10,4 | 1,94 |
| 25–12,5 | 5,27 | 2,03 | 0,10 | 13,1 | 0,47 | 45,00 | 16,2 | 4,0 | 12,2 | 2,16 |
| 2,5–5 | 6,32 | 1,86 | 0,11 | 16,3 | 0,52 | 40,00 | 16,6 | 4,0 | 10,9 | 2,87 |
| 5–2,5 | 5,63 | 2,01 | 0,11 | 16,1 | 0,59 | 37,00 | 18,2 | 3,6 | 11,5 | 3,02 |
| 2,5–1 | 3,45 | 1,94 | 0,11 | 13,1 | 0,66 | 40,00 | 20,7 | 3,8 | 10,9 | 2,74 |
| 1–0,5 | 3,52 | 1,82 | 0,11 | 13,1 | 1,15 | 39,00 | 20,9 | 4,0 | 10,1 | 2,84 |
| 0,5–0,25 | 5,33 | 1,91 | 0,12 | 14,3 | 2,12 | 39,00 | 17,1 | 5,1 | 10,2 | 2,86 |
| 0,25–0,125 | 7,87 | 1,84 | 0,09 | 15,6 | 1,63 | 45,00 | 12,3 | 4,3 | 9,5 | 2,05 |
| 0,125–0,063 | 11,37 | 2,15 | 0,08 | 18,9 | 0,94 | 44,00 | 11,4 | 3,4 | 9,4 | 0,93 |
| 0,063–0,040 | 5,14 | 2,42 | 0,08 | 19,6 | 0,71 | 40,00 | 13,1 | 3,0 | 9,8 | 0,45 |
| 0,040–0,020 | 6,17 | 2,47 | 0,08 | 21,6 | 0,66 | 35,00 | 13,3 | 3,2 | 10,9 | 1,47 |
| 0,020–0,010 | 3,05 | 2,82 | 0,10 | 23,4 | 0,66 | 29,00 | 13,3 | 3,4 | 12,1 | 1,41 |
| -0,010 | 26,00 | 3,64 | 0,11 | 21,0 | 0,46 | 31,00 | 14,6 | 3,6 | 11,9 | 0,53 |
| Feed | 100,00 | 2,47 | 0,10 | 17,43 | 0,77 | 39,27 | 14,85 | 3,63 | 10,69 | 1,60 |
| >50 mm | 5,31 | 3,27 | 4,77 | 3,11 | 2,84 | 8,11 | 4,40 | 2,78 | 4,22 | 7,61 |
| 50–25 | 5,57 | 4,87 | 6,11 | 3,99 | 3,48 | 6,53 | 6,41 | 5,53 | 5,42 | 6,74 |
| 25–12,5 | 5,27 | 4,33 | 5,26 | 3,96 | 3,23 | 6,04 | 5,75 | 5,81 | 5,52 | 7,10 |
| 2,5–5 | 6,32 | 4,76 | 6,93 | 5,91 | 4,28 | 6,44 | 7,06 | 6,97 | 6,45 | 11,31 |
| 5–2,5 | 5,63 | 4,58 | 6,18 | 5,20 | 4,33 | 5,31 | 6,90 | 5,59 | 6,06 | 10,60 |
| 2,5–1 | 3,45 | 2,71 | 3,79 | 2,59 | 2,97 | 3,51 | 4,81 | 3,61 | 3.52 | 5,89 |
| 1–0,5 | 3,52 | 2,59 | 3,86 | 2,65 | 5,27 | 3,50 | 4,95 | 3,88 | 3,33 | 6,23 |
| 0,5–0,25 | 5,33 | 4,12 | 6,38 | 4,37 | 14,72 | 5,29 | 6,14 | 7,49 | 5,09 | 9,50 |
| 0,25–0,125 | 7,87 | 5,86 | 7,06 | 7,04 | 16,71 | 9,02 | 6,52 | 9,33 | 7.00 | 10,06 |
| 0,125–0,063 | 11,37 | 9,90 | 9,07 | 12,33 | 13,92 | 12,74 | 8,73 | 10,66 | 10,00 | 6,59 |
| 0,063–0,040 | 5,14 | 5,04 | 4,10 | 5,78 | 4,75 | 5,24 | 4,53 | 4,25 | 4,71 | 1,44 |
| 0,040–0,020 | 6,17 | 6,17 | 4,92 | 7,65 | 5,30 | 5,50 | 5,52 | 5,44 | 6,29 | 5,65 |
| 0,020–0,010 | 3,05 | 3,48 | 3,04 | 4,09 | 2,62 | 2,25 | 2,73 | 2,86 | 3,45 | 2,68 |
| -0,010 | 26,00 | 38,32 | 28,53 | 31,32 | 15,58 | 20,53 | 25,56 | 25,80 | 28,95 | 8,59 |
| Feed | 100,00 | 100 | 100 | 100 | 100 | 100 | 100 | 100 | 100 | 100 |

EXAMPLE 2

Table 1 demonstrates that the particles larger than 10 microns have lower nickel contents. Particles of a size exceeding 40 microns were therefore investigated with respect to the quantity and nickel content of the secondary fines produced therefrom as a function of duration of wet attrition.

500 grammes of a solid of particle size as shown in Table 2 were mixed with 500 grammes of water, containing as dispersant a sodium hexamethaphosphate at the rate of 100 grammes per ton of solid product, in a 1 liter laboratory attrition cell. Samples of each fraction were subjected to attrition for 5, 15 or 30 minutes; the products obtained were screened and the portion smaller than 40 microns was then hydrocycloned to separate the particles smaller than 10 microns. The nickel analyses of each fraction are shown in the following Table 2:

TABLE 2

| FRACTION treated size in mm | Ni percentage of the fraction smaller than 10 microns after attrition for 5 min. | 15 min. | 30 min. | Percentage of the fraction smaller than 40 microns after attrition for 5 min. | 15 min. | 30 min. | Percentage of the fraction smaller than 10 microns after attrition for 5 min. | 15 min. | 30 min. |
|---|---|---|---|---|---|---|---|---|---|
| 2.5 -5 | 3.64 | 3.49 | 3.42 | 28 | 37 | 42.5 | 16 | 21 | 25 |
| 2.5-0.125 | 4.07 | 3.76 | 3.68 | 12.5 | 19 | 24 | 8.5 | 13 | 15 |
| 0.125-0.040 | 4.30 | 4.34 | 4.20 | 10 | 16 | 20 | 7 | 14 | 17 |

Then all of the fractions except the primary fines (i.e., those having a particle size below 10 microns after a single controlled attrition step) were subjected to a further controlled attrition as follows:

the fraction exceeding 2.5 mm was crushed and reduced to 1.25 mm, then subjected to controlled attrition in the laboratory cell for a period of 30 minutes;

the fractions smaller than 2.5 mm were passed through a screen of 125 microns mesh size, the matter passing through being hydrocycloned to obtain primary fines smaller than 10 microns, and the 10 to 125 micron fraction was subjected to controlled attrition for 30 minutes as specified above;

the 125 micron to 2.5 mm fraction was subjected to controlled attrition for 30 minutes, then hydrocycloned. Thus 10 products (sub-fractions) were obtained, possessing the characteristics shown in Table 3:

TABLE 3

| Initial Fraction | Size of sub-fraction after attrition | % of sub-fraction | % Ni in sub-fraction | Distribution Ni % |
|---|---|---|---|---|
| greater than than 2.5 mm (2500 microns) | greater than 40 microns | 18.05 | 1.4 | 10.40 |
| | between 10 and 40 microns | 6.25 | 2.0 | 5.14 |
| | smaller than 10 microns | 3.80 | 3.40 | 5.34 |
| 125 to 2500 microns | greater than 40 microns | 14.93 | 1.5 | 9.21 |
| | 10 to 40 microns | 1.85 | 2.1 | 1.60 |
| | smaller than 10 microns | 3.39 | 3.9 | 5.44 |
| 10 to 125 microns | smaller than 10 microns | 21.49 | 3.96 | 35.02 |
| | greater than 40 microns | 14.61 | 1.8 | 10.82 |
| | 10 to 40 microns | 12.59 | 2.2 | 11.40 |
| | smaller than 10 | | | |

BEST AVAILABLE COPY

TABLE 3-continued

| Initial Fraction | Size of sub-fraction after attrition | % of sub-fraction | % Ni in sub-fraction | Distribution Ni % |
|---|---|---|---|---|
| | microns | 3.04 | 4.5 | 5.63 |
| smaller than 10 microns(primary fines) | | 21.49 | 3.96 | 35.02 |
| Total of the fractions | | 100.00 | 2.43 | 100.00 |
| Total of the fractions < 10 microns | | 31.72 | 3.94 | 51.43 |
| Total of the fractions < 40 microns | | 52.41 | 3.23 | 69.57 |

In accordance with the present invention, it is thus possible to obtain an upgraded nickel ore having a nickel content of 3.94% and containing 51.4% of the total of the nickel of the ore if only the particles smaller than 10 microns are recovered, or a pre-concentrate having a nickel content of 3.23% and containing close to 70% of the nickel contained in the ore if the particles smaller than 40 microns are recovered.

The addition of the fine particles thus produced to the primary fines obtained during the first hydrocyclonal separation, permits a substantial increase in the recovery of nickel for a product having a particle size less than 10 microns and a nickel content of the order of 3.60 to 4.00%.

EXAMPLE 3

This example shows the effect of centrifuging a fraction having a particle size less than 10 microns.

The operation was begun by allowing a pulp prepared as in Example 1 and containing the fraction smaller than 10 microns to settle to a solids content of 10%. The supernatant liquid was subjected to a series of centrifuging operations at increasing speed for a period of 10 minutes in a laboratory centrifuge sold under the trade name "Sorvall". The products remaining in the supernatant state after each treatment at a given acceleration were subjected to another treatment at a higher acceleration.

At the end of these sedimenting and centrifuging operations, the initial fraction smaller than 10 microns had been separated into sub-fractions of constantly decreasing particle size which were increasingly richer in nickel, as evident from Table 4.

TABLE 4

| Identification of the sub-fractions | Percentage | Percentage of Ni | Distribution of Ni % |
|---|---|---|---|
| Sedimentation deposit after 10 min | 17.07 | 2.14 | 12.21 |
| Sedimentation deposit after 40 min | 11.20 | 2.36 | 8.83 |
| Sedimentation deposit after 2 hr | 11.82 | 2.54 | 10.03 |
| Sedimentation deposit after 10 hr | 14.98 | 2.77 | 13.86 |
| Sedimentation deposit after 16 hr | 6.20 | 3.10 | 6.42 |
| Centrifugation deposit at 1830 g | — 25.28 | 3.28 | 27.72 |
| Centrifugation deposit at 3900 g | 5.63 | 3.92 | 7.37 |
| Centrifugation deposit at 8600 g | 3.96 | 4.74 | 6.27 |
| Centrifugation deposit at 29000 g | 3.86 | 5.62 | 7.25 |
| Total initial fraction | 100.00 | 2.99 | 100.00 |

EXAMPLE 4

Examples 4 and 5 illustrate the use of flocculants to assist decanting.

A flocculant of the polyacrylamide type sold under the brand name "Separan AP 30" was added to a one-liter test cylinder containing the ore pulp described in Example 3 in which the solid fraction comprised particles smaller than 10 microns and represented 10% of the total weight of the pulp. After adjusting the pH to 6.7, flocculant was added progressively with moderate stirring until the amount added was 1500 grammes per tonne of dry material.

The results of the pulp decantation are given in the following Table 4A:

TABLE 4A

| Decanting period in mins. | Height of clarified solution in mm | Height of thickened pulp in mm |
|---|---|---|
| 0 | 0 | 360 |
| 12 | 30 | 330 |
| 20 | 40 | 320 |
| 30 | 50 | 310 |
| 40 | 115 | 245 |
| 60 | 165 | 195 |
| 120 | 185 | 175 |
| 180 | 195 | 165 |
| 240 | 200 | 160 |
| 300 | 200 | 160 |
| 1440 | 210 | 150 |

From this data it was calculated, by the Kynch-Roberts method, that the thickener had a surface of the order of 43 $m^2$ per hour per dry tonne.

Filtration tests on the decanted product were performed using a filter of sufficient capacity to be of use on an industrial scale, since it requires no more than 23 $m^2$ per hour per dry tonne. The water content of the filtered product was about 30%.

EXAMPLE 5

The procedure of Example 4 was repeated but replacing the polyacrylamide by a polyethylene oxide flocculant sold under the trade name "Floerger FA 10". The decanting of the flocculated product occurred at the speed given in the following Table 5:

TABLE 5

| Decanting period in mins. | Height of clarified solution in mm | Height of thickened sludge in mm |
|---|---|---|
| 0 | 0 | 335 |
| 7 | 85 | 250 |
| 15 | 100 | 235 |
| 30 | 125 | 210 |
| 60 | 130 | 205 |
| 120 | 130 | 205 |
| 180 | 135 | 200 |
| 300 | 140 | 195 |
| 1290 | 170 | 165 |

From this data obtained it was calculated, by the Kynch-Roberts method, that the thickener had a surface of the order of 46 $m^2$ per hour per dry tonne.

Filtration tests performed on this thickened product were performed using a filter of a capacity identical to that of the filter of the preceding sample. The water content of the filtered product was about 40%.

In further tests, a co-polymer of acrylate and acrylamide sold under the Trade Mark "Sedipur T.F.5" yielded comparable results to those cited in the two preceding examples.

EXAMPLE 6

This example shows the effect of high-intensity magnetic separation in liquid phase.

A laboratory magnetic separator sold under the Trade Mark CARPCO, type MWL 3465 was employed in which the gas was filled with 12 mm balls. The pulp described in Example 3, where the solid fraction comprises particles smaller than 10 microns and respresents 10% of the total weight of the pulp, was induced to flow in the gap. The products which were magnetic at a given field strength were recovered after a single passage through the gap; the products which were non-magnetic at this same field strength were passed through the gap again at a higher field strength.

The following results are obtained at the end of the operation:

TABLE 6

| Products | Weight % | Ni content % | Distribution of the Ni % |
|---|---|---|---|
| Magnetic at 0.25 A | 4.20 | 2.48 | 2.95 |
| Magnetic at 0.50 A | 2.92 | 2.74 | 2.26 |
| Magnetic at 2 A | 9.02 | 2.80 | 7.13 |
| Magnetic at 3 A | 10.69 | 3.02 | 9.12 |
| Magnetic at 4 A | 8.44 | 3.06 | 7.30 |
| Magnetic at 5.4 A | 5.80 | 3.04 | 4.98 |
| Non-magnetic at 5.4 A | 58.93 | 3.98 | 66.27 |
| Supply | 100 | 3.54 | 100.00 |

A non-magnetic concentrate was thus obtained which had a nickel content of close to 4% and which contained 66.27% of the nickel of the fraction, whereas the initial fraction supplied had a nickel content of only 3.54%.

EXAMPLE 7

This example shows the effect of high-intensity magnetic separation on the tailings larger than 10 microns from primary hydrocycloning.

A magnetic separator sold under the trade name "Frantz Isodynamic" was used in conventional manner. The fraction of particle size 63 to 125 microns was used. After removal of ferro magnetic particles by means of a permanent magnet, the products which were magnetic at a given intensity were withdrawn and the remainder which as non magnetic at this same intensity, was subjected to a greater magnetic intensity, as described in Example 6.

The following results we obtained at the end of the operation:

TABLE 7

| Products | Weight % | Ni Content % | Distribution of the Ni % |
|---|---|---|---|
| Ferro-magnetic | 2.95 | 2.33 | 3.29 |
| Magnetic at 0.12 A | 4.56 | 2.14 | 4.68 |
| Magnetic at 0.25 A | 13.94 | 2.24 | 14.97 |
| Magnetic at 0.50 A | 27.61 | 2.70 | 35.73 |
| Magnetic at 1.0 A | 19.03 | 2.12 | 19.34 |
| Magnetic at 1.25 A | 28.69 | 1.56 | 21.45 |
| Non magnetic at 1.25 A | 3.22 | 0.35 | 0.54 |
| Initial Fraction | 100 | 2.09 | 100.00 |

The initial fraction had a nickel content of 2.09%; a concentrate having a nickel content of 2.49% and which represents 57.8% of the nickel contained in the initial fraction was obtained by summation of the ferro magnetic and magnetic fractions obtained up to a magnetic field strength of 0.50 Amperes.

The greater proportion of the particles in the fractions obtained from the Tiebaghi ore thus have paramagnetic properties. It has consequently been demonstrated that a heterogeneity exists in the paramagnetic properties of the particles of size greater than 10 microns that this heterogeneity may be exploited for nickel enrichment.

The results of these laboratory tests would indicate that, for example, separators making use of super-conductors or separators of the "carousel" type, sich as separators using the wet method which are marketed under the trade names "Jones" or "Carpco" could be used industrially.

EXAMPLE 8

Upgrading by dry attrition of a garnieritic mineral of New Caledonia (Poro mine).

A sample of garnieritic mineral was first dried, then ground to a mesh of 2.5 mm.

The attrition was performed in a 10 liter grinder filled with ore and grinding body in a ratio of 1:4. The grinding body consisted of balls of diameter 4–5 mm and the speed of the grinder was controlled in the vicinity of the critical speed (90% thereof) in order to ensure attrition of the particles. The first step was carried out for 5 minutes, then followed by separation of fines, and the larger particles were again submitted to the same treatment for a longer time. After a total attrition time of 2 hours, the fines represented 70% of the weight of the metal in the ore, and had a mean nickel content of 4.1%, while the treated ore had 2.65% nickel.

The invention thus enabled a considerable upgrade of nickel ores with satisfactory recovery of metal. It should be noted however, that the recovery was less than that obtained by wet attrition as described in Example 10.

EXAMPLE 9

Upgrade of a garnieritic ore (Tiebaghi mine).

The garnieritic ore described in Example 1 was first washed and then hydrocycloned to recovery primary fines, while the bottoms from the hydrocyclone were ground for one hour. The products thus obtained were hydrocycloned, the tops constituting the concentrate, the bottoms being ground again for one hour and then finally hydrocycloned.

The combination of the three top fractions from the hydrocyclone gave a concentrate having the following characteristics, the values being percentages by weight.

Ni=3.86; Fe=17.8; Cr=0.39; Co=0.11; MgO=16.6; SiO=34.0; $Al_2O_3$=3.6; Ignition loss=10.6; $CO_2$=0.11.

This concentrate, having 3.86% nickel, represented 61% of the metal in the ore, which had a nickel content of 2.40%. The invention thus enabled a considerable upgrade of nickel in the concentrate, and also enabled one to obtain more favourable concentration of MgO, $SiO_2$ and Fe for reductive fusion.

In fact the ratios of $MgO/SiO_2$ and Fe/Ni, respectively, went from 0.38 and 7 for the ore to 0.49 and 4.6 for the concentrate.

EXAMPLE 10

Comparison between the upgrading obtained by grinding and that obtained by attrition using a garnieritic mineral of New Caledonia (Poro mine).

Three samples of a Poro ore are each treated by a different process in order to obtain upgraded fine particles.

The first process consists of a simple granulometric classification.

The second process consists of a wet grinding in a ball-mill (with balls of diameter about 5 mm) controlled by to work under conditions of attrition (speed very close to the critical speed).

The third process consists of attrition as described in Examples 2 and 9. The peripheral speed was 6.6 meters per second.

The comparative results are shown in the following Table 8:

TABLE 8

| | | | | | | | | | |
|---|---|---|---|---|---|---|---|---|---|
| Cumulative Distribution of Nickel (%) | | 7.5 | 30.0 | 46.0 | 57.5 | 69.0 | 80.0 | 90.0 | 100.0 (feed ore) |
| Total particles size less than (micron) | | 10 | 40 | 250 | 500 | 800 | 1,250 | 2,500 | e |
| 1 | Granulometric classification of feed ore | Nickel content (%) | 4.70 | 3.70 | 3.30 | 3.10 | 2.90 | 2.90 | 2.70 | 2.65 |
| 2 | Concentrate obtained by attrition in ball mill | Nickel content (%) | 4.70 | 4.75 | 4.50 | 4.10 | 3.65 | 3.30 | 3.00 | 2.65 |
| 3 | Concentrate obtained by attrition by agitation | Nickel content (%) | 4.70 | 4.86 | 4.83 | 4.68 | 4.43 | 4.00 | 3.50 | 2.6 |

The best upgrading method thus consists of attrition under the conditions defined above. The nickel content can be raised by 50% from 2.65% in the ore to 4%, with a recovery of 80%, while simple grinding results in a significantly lower yield of 60%.

EXAMPLE 11

Upgrade of a Brazilian garnieritic ore.

A sample of ore having a nickel content of 1.6% was treated according to the invention. 60% of the solid was first pulped in a first attrition stage of 5 minutes, followed by hydrocycloning to 10 microns.

The attrition separation is then repeated over 15 minutes on the fraction larger than 10 microns, followed by a further hydrocycloning operation and a further 30 minute attrition step. A summary of the upgrade is shown in the following Table 9:

TABLE 9

| | % Weight | | % Ni | | % Distribution Ni | |
|---|---|---|---|---|---|---|
| | Partial | Cumulative | Partial | Cumulative | Partial | Cumulative |
| <10 μm after 1st attrition | 16,5 | 16,50 | 3,56 | 3,56 | 36,48 | 36,48 |
| <10 μm after 2nd attrition | 15,0 | 31,50 | 2,95 | 3,26 | 27,48 | 63,96 |
| <10 μm after 3rd attrition | 9,5 | 41,00 | 2,26 | 3,03 | 13,33 | 77,30 |
| 10–40 μm after 3rd attrition | 15,8 | 56,80 | 0,86 | 2,43 | 8,44 | 85,78 |
| >40 μm after 4th attrition | 43,2 | 100,00 | 0,53 | 1,60 | 14,22 | 100,00 |
| Feed | 100,00 | 100,00 | 1,60 | | 100,00 | |

This example shows that after 50 minutes of attrition, the upgraded fraction had a nickel content of 3.03%, and contained 77.3% of the weight of the metal in the ore, which itself had a metal content of 1.60%. The concentration factor, defined as the ratio between the nickel content of the concentrate and that of the feed is therefore about 90% with an high recovery of metal.

A further advantage of the invention is that the $MgO/SiO_2$ ratio is raised from from 0.24 in the ore to 0.65 in the concentrate. The concentrate obtained is thus more favourable as a feed for pyrometallurgical treatement (or fusion working).

EXAMPLE 12

Flocculation using slightly anionic polyacrylamide.

Into a liter cylinder containing pulp in which the solid fraction was composed of particles smaller than 10 microns and of weight 20 g was added a flocculant sold under the Trade Mark "Floerger FA 57H" (previously diluted to 0.1 g/; the pH obtained being naturally about 7). After addition of 300 g of flocculant per tonne of solids and agitation for about one minute, the speed of decantation into a liter cylinder of height 335 mm was measured. The results are shown in the following Table 10:

TABLE 10

| Decantation Time | Height of clarified solution (in mm) |
|---|---|
| 0 | 0 |
| 10 seconds | 240 |
| 30 seconds | 270 |
| 60 seconds | 278 |
| 2 minutes | 282 |
| 5 minutes | 286 |
| 6 minutes | 287 |
| 12 minutes | 288 |
| 15 minutes | 289 |
| 18 minutes | 289 |
| 21 minutes | 289 |
| 30 minutes | 289 |
| 40 minutes | 290 |
| 50 minutes | 290 |
| 60 minutes | 290 |
| 120 minutes | 291 |

The results obtained in this experiment enable one to calculate, by the Kynch-Roberts method, a surface for the thickener of about 10 $m^2$ per tonne of solid per hour.

The thickened pulp at the base of the cylinder then had a solids concentration of about 150 g/. Analogous results could therefore be expected using an industrial thickener.

These results could be considerably improved, obtaining a solids concentration of 25–30% by using, instead of a thickener, a revolving screen (trommel) -drainer, which received the pulp directly after flocculation. This apparatus consisted of a horizontal cylinder having a full part in which flocculation was terminated, followed by a liberally perforated part covered by a sieve cloth of mesh 1 mm.

The apparatus must rotate slowly in order to permit granulation of the flocs, without destroying them, and to favour elimination of water: e.g., at about 3–5 revolutions per minute. The granules thus formed, of size 2–4 cm, were extracted using an endless screw of which the thread determined the residence time in the trommel.

The thus-treated pulp had the double advantage of being better dried and of having better mechanical properties for subsequent more powerful dehydration operations.

We claim:

1. A process for upgrading garnieritic ores to obtain an upgraded ore of higher nickel content comprising the steps of:

(a) subjecting a garnieritic ore in which about 80% of the ore particles have a size between about 5000 and 100 microns to a controlled attrition to produce fine particles whereby a ratio $d_{90}/d_{10}$ measured after said controlled attrition is larger by a factor of at least 2.0 than a ratio of $d_{90}/d_{10}$ measured before said controlled attrition and whereby $d_{90}$ measured after said controlled attrition is no more than 75% less than $d_{90}$ measured before said controlled attrition; and (b) classifying the ore particles resulting from the attrition according to their size into at least two fractions and recovering the ore particles of a size below 50 microns as the upgrased ore of higher nickel content.

2. The process according to claim 1 comprising the additional step of pulping the ore prior to step (a).

3. The process according to either claim 1 comprising the additional step of recycling oversize unrecovered particles to step (a).

4. The process according to claim 2 wherein the controlled attrition is carried out employing an agitating device so that the agitated volume of pulp passes through said agitating moving device between about 1,000 and 10,000 times per hour.

5. The process according to claim 4 wherein the agitated volume of pulp passes through said agitating device between about 3,000 and 5,000 times per hour.

6. The process according to claim 3 wherein the oversize particles are recycled from 1 to 4 times to step (a), whereby the controlled attrition is performed in from 1 to 5 operations, the duration of each being from about 20 minutes to about 2 hours, and with the duration of step (a) increasing with each successive cycle.

7. The process according to claim 6 wherein the total duration of controlled attrition is from about 1 to 5 hours.

8. The process according to claim 1 wherein step (a) includes the step of subjecting the garnieritic ore to a preliminary crushing or grinding.

9. The process according to claim 1 comprising the additional step of recycling unrecovered oversize ore particles to step (a) and repeating the process as many times as required to achieve a minimum nickel recovery of 70%.

10. The process of clam 9 whereby the controlled attrition is performed in from 1 to 5 operations, the duration of each being from about 20 minutes to about 2 hours, and with the duration of each attrition increasing with each successive operation.

11. The process of claim 10 wherein the total duration of the controlled attrition is from about 1 to about 5 hours.

12. The process of claim 11 wherein the total duration of the controlled attrition is from about 1 to about 3 hours.

13. The process according to claim 9 wherein the ratio $d_{90}/d_{10}$ increases by a factor of at least 10.

14. The process according to claim 9 wherein the recovered ore particles are smelted to obtain ferro-nickel.

15. The process according to claim 1 wherein step (b) comprises the step of recovering the ore particles of a size below 10 microns.

16. The process according to claim 1 wherein about 80% of the ore particles in step (a) have a size between about 1,000 and 200 microns.

17. The process according to claim 1 comrising the additional step of pulping the garnieritic ore prior to step (b).

18. The process according to claim 1 wherein the controlled attrition is a dry attrition carried out in a rotating crusher operated to avoid a waterfall effect at less than about 60% or between about 80 and 100% of the critical speed of said crusher.

19. The process according to claim 1 wherein $d_{90}$ measured after said controlled attrition is no more than 20% less than $d_{90}$ measured before said controlled attrition.

20. A process for upgrading garnieritic ores at least 0.5% in nickel, comprising the steps of:

(a) subjecting a garnieritic ore to a preliminary grinding or crushing to produce an ore in which about 80% of the ore particles have a size between about 5000 and 100 microns;

(b) subjecting the resultant ore to a controlled attrition to produce fine particles whereby a ratio $d_{90}/d_{10}$ measured after said controlled attrition is larger by a factor of at least 2.0 than a ratio of $d_{90}/d_{10}$ measured before said controlled attrition and whereby $d_{90}$ measured after said controlled attrition is no more than 75% less than $d_{90}$ measured before said controlled attrition; and (c) classifying the ore particles resulting from the attrition according to their size into at least two fractions and recovering the ore particles of a size below 10 microns whereby a nickel recovery of at least 70% is accomplished.

21. The process according to either claim 1 or 2 wherein the total duration of the controlled attrition step is from about 1 to 5 hours.

22. The process according to either claim 1 or 2 wherein the total duration of the controlled attrition step is from about 1 to 3 hours.

23. The process according to either claim 1 or 2 wherein the recovered particles are smelted to obtain ferro-nickel.

24. The process according to either claim 1 or 2 wherein a minimum upgrading is nickel of 0.5% and a minimum nickel recovery of 70% are accomplished.

25. The process according to clam 20 comprising the additional step of pulping the preliminary ground or crushed ore prior to step (b).

26. The process according to either claim 20 or 25 comprising the additional step of recycling the unrecovered oversize ore particles to step (b).

27. The process according to claim 26 wherein the recycling is repeated so that the controlled attrition is performed in from 1 to 5 operations the duration of each operation being from about 20 minutes to about 2 hours and with the duration of each controlled attrition increasing with each successive cycle.

28. The process according to claim 27 wherein the total duration of the controlled attrition is from about 1 to 3 hours.

29. The process according to claim 25 wherein the attrition is carried out employing an agitating device so that the agitated volume of pulp passes through said moving device between about 3,000 and 5,000 times per hour.

30. The process according to claim 25 wherein the resultant pulp has a solids content of between about 60 and 80%.

31. The process according to claim 30 wherein the solids content is about 70%.

32. The process according to claim 20 wherein the controlled attrition is a dry attrition carried out in a rotating crusher operated to avoid a waterfall effect at less than about 60% or between about 80 and 100% of the critical speed of said crusher.

33. The process according to either claim 20 or 25 wherein the recovered ore particles are smelted to produce ferro-nickel.

34. The process according to claim 20 wherein $d_{90}$ measured after said controlled attrition is no more than 20% less than $d_{90}$ measured before said controlled attrition.

35. The process according to claim 2 wherein the resultant pulp has a solids content of from about 60 to 80%.

36. The process according to claim 35 wherein the solids content is about 70%.

37. A process for upgrading garnieritic ores to obtain an upgraded ore of higher nickel content, comprising the steps of:

(a) subjecting a garnieritic ore pulp in which about 80% of the ore particles have a size between about 5000 and 100 microns to a controlled attrition to produce fine particles whereby a ratio $d_{90}/d_{10}$ measured after said controlled attrition is larger by a factor of at least 2.0 than a ratio of $d_{90}/d_{10}$ measured before said controlled attrition and whereby $d_{90}$ measured after said controlled attrition is no more than 75% less than $d_{90}$ measured before said controlled attrition, said attrition being carried out in an agitating device in which the agitated volume of pulp passes through the agitating device between about 1,000 and 10,000 times per hour; and (b) classifying the ore particles resulting from the attrition according to their size into at least two fractions and recovering the ore particles of a size below 50 microns as the upgraded ore of higher nickel content.

38. The process according to claim 37 wherein $d_{90}$ measured after said controlled attrition is no more than 20% less than $d_{90}$ measured before said controlled attrition.

* * * * *